US005323526A

United States Patent [19]

Saul et al.

[11] Patent Number: 5,323,526

[45] Date of Patent: Jun. 28, 1994

[54] METHOD FOR ASSEMBLING A MODULAR WALL PROXIMITY RECLINING CHAIR

[75] Inventors: Jonathan R. Saul, LaSalle; Karl J. Komorowski, Petersburg; Larry P. LaPointe, Temperance, all of Mich.

[73] Assignee: La-Z-Boy Chair Company, Monroe, Mich.

[21] Appl. No.: 897,546

[22] Filed: Jun. 18, 1992

Related U.S. Application Data

[63] Continuation-in-part of Ser. No. 819,784, Jan. 13, 1992, Pat. No. 5,222,286, which is a continuation-in-part of Ser. No. 772,231, Oct. 11, 1991, and a continuation-in-part of Ser. No. 647,017, Feb. 1, 1991, Pat. No. 5,141,284.

[51] Int. Cl.[5] ..... A47C 1/02; B23P 11/00

[52] U.S. Cl. ..... 29/436; 29/434; 297/83; 297/342

[58] Field of Search ..... 29/91, 91.1, 434, 436; 297/83, 85, 259, 317, 318, 322, 329, 271, 340, 341, 342, 343, 344, DIG. 7

[56] References Cited

U.S. PATENT DOCUMENTS 1,048,306 12/1912 Greilick .
2,677,412 5/1954 Thomas .
2,918,110 12/1959 Schliephacke .
2,918,111 12/1959 Schliephacke .
2,919,745 1/1960 Schliephacke .
3,096,121 7/1963 Knabusch et al. .
3,567,280 3/1971 Bradshaw .
3,858,932 1/1975 Crum et al. .
3,904,240 9/1975 Rogers, Jr. et al. .
4,071,275 1/1978 Rogers, Jr. .
4,226,469 10/1980 Rogers, Jr. et al. .
4,291,913 9/1981 Kowalski .
4,364,603 12/1982 Johnson .
4,367,895 1/1983 Pacitti et al. .
4,740,031 4/1988 Rogers, Jr. .
5,011,220 4/1991 LaPointe .

FOREIGN PATENT DOCUMENTS 73511 1/1986 Taiwan .

*Primary Examiner*—Timothy V. Eley
*Attorney, Agent, or Firm*—Harness, Dickey & Pierce

[57] ABSTRACT

A modular wall proximity reclining/tilt chair and method for assembling it are disclosed. The modular wall proximity reclining/tilt chair includes a simplified actuation mechanism which significantly reduces system complexity and weight while providing improved comfort to the seat occupant. The construction is such that the pre-assembled actuation mechanism is integrally suspended from and interdependent with box-like modular frame components. In this manner, the frame components can be upholstered prior to final assembly with the actuation mechanism.

20 Claims, 9 Drawing Sheets

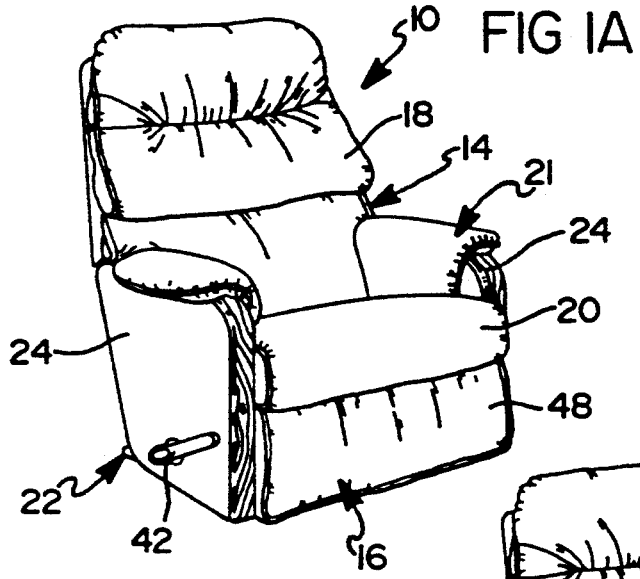
FIG IA
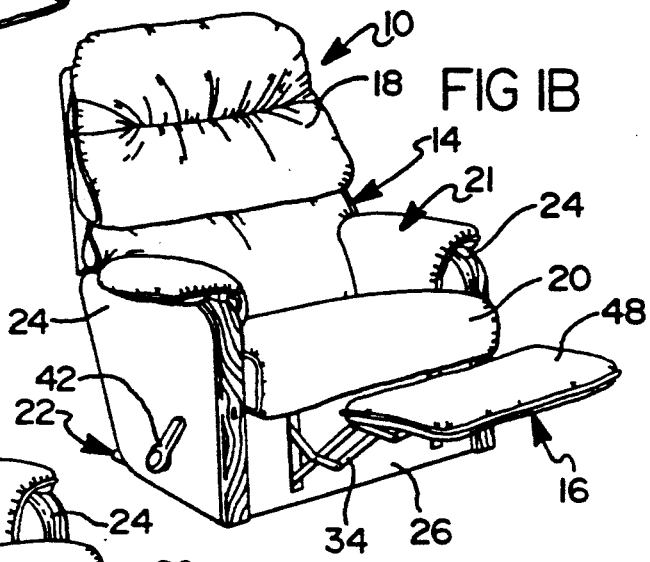
FIG IB
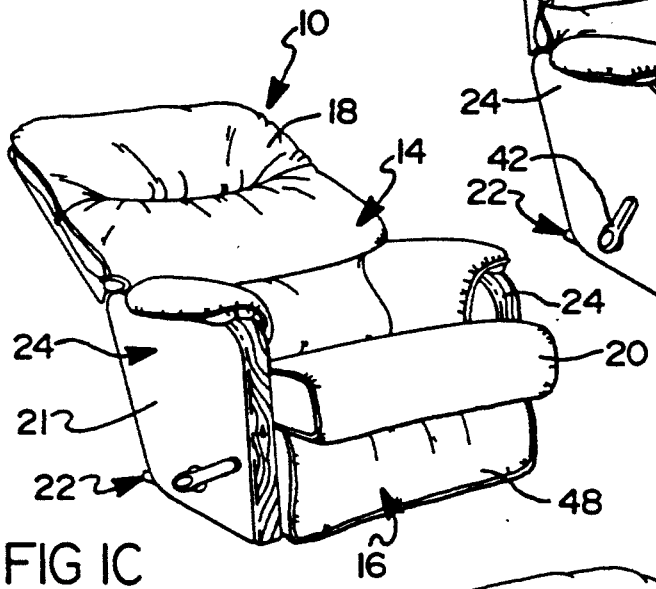
FIG IC
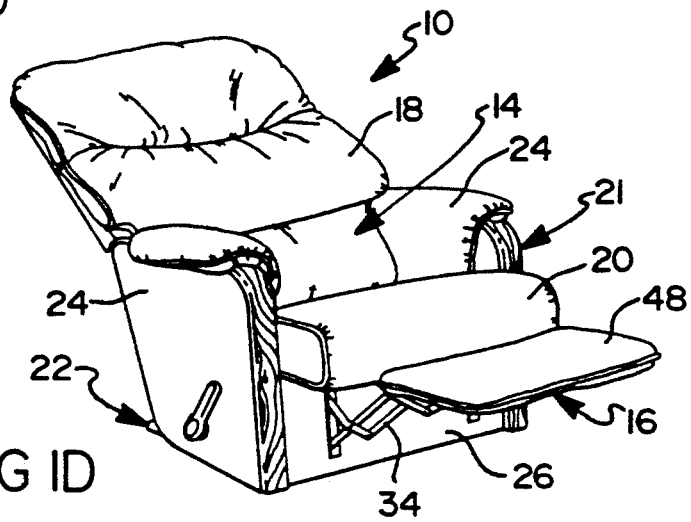
FIG ID

FIG 7G
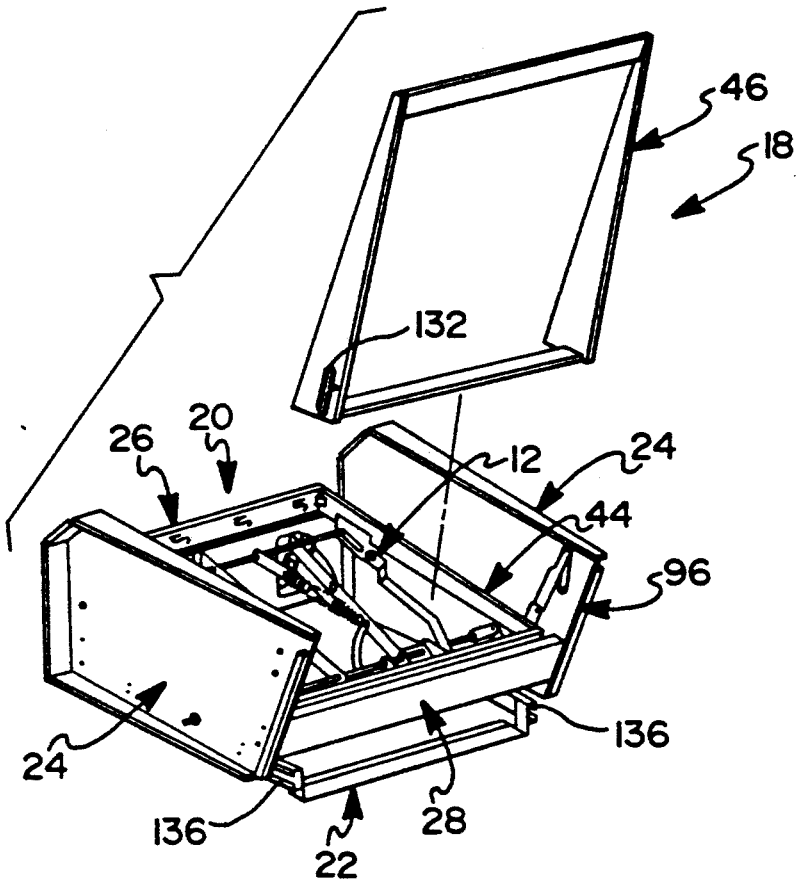
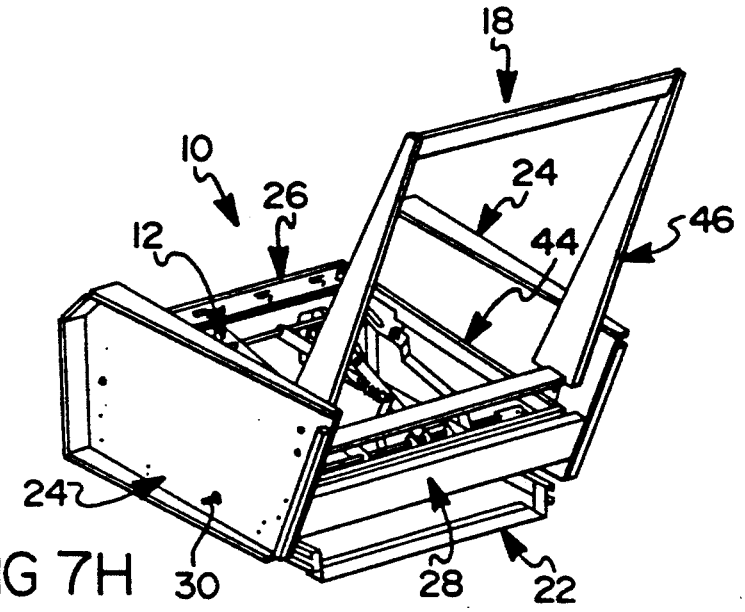
FIG 7H

METHOD FOR ASSEMBLING A MODULAR WALL PROXIMITY RECLINING CHAIR

BACKGROUND OF THE INVENTION

This is a continuation-in-part of U.S. patent application Ser. No. 07/819,784, filed on Jan. 13, 1992 and entitled "Modular Reclining/Tilt Chair And Method" now U.S. Pat. No. 5,222,286, which is a continuation-in-part of U.S. Ser. No. 07/772,231, filed on Oct. 11, 1991 and entitled "Modular Reclining Chair And Method", both assigned to the common assignee of the present invention, the disclosures of which are both hereby expressly incorporated by reference. This is also a continuation-in-part of U.S. patent application Ser. No. 07/647,017, filed Feb. 1, 1991 and entitled "Wall Proximity Reclining Chair Mechanism" now U.S. Pat. No. 5,141,284, assigned to the common assignee of the present application, the disclosure of which is also expressly incorporated by reference herein.

The present invention relates generally to reclining chairs and, more particularly, to a method for assembling an improved "wall proximity" reclining chair from pre-assembled modular components.

Traditionally, reclining chairs are equipped with an actuation mechanism which is operatively interconnected between a prefabricated chair frame and a stationary base assembly. The actuation mechanism is typically a combination of various mechanical linkages operable for providing various comfort features such as independent reclining movement of a seat assembly as well as actuation of an extensible leg rest assembly and associated tilting of the chair frame. In "wall proximity" reclining chairs, the actuation mechanism must also be operable to maintain a generally constant clearance between the reclinable seat assembly and an adjacent stationary structure (i.e., wall surface, table, etc.) during the entire range of reclining movement. Generally, the actuation mechanism includes a track arrangement for causing longitudinal movement of the entire chair frame relative to the stationary base assembly during "wall proximity" reclining movement to accommodate for rearward angular movement of the seat back relative to the chair frame.

Due to the relative complexity of conventional actuation mechanisms, it is common practice in the furniture industry to assemble the various mechanical linkages into a "stand-alone" mechanism frame assembly. A prefabricated U-shaped chair frame is frequently bolted around the mechanism frame with the open portion of the "U" corresponding to the front of the chair. Accordingly, such reclining chairs having a mechanism frame assembly located within a prefabricated chair frame are commonly referred to as having a "frame within a frame" construction. As such, most furniture manufacturers do not upholster the exterior surfaces of the prefabricated chair frame until after the mechanism frame assembly has been installed. Unfortunately, the upholstering operation is very inefficient and expensive in that the frequently heavy and cumbersome prefabricated chair frame must be manually manipulated in an extremely labor-intensive manner.

Another disadvantage associated with reclining chairs equipped with conventional actuation mechanisms is that a relatively large amount of frictional drag is typically generated between the upholstered components which must be overcome for smooth movement of the seat assembly between the "upright" and "reclined" positions. As such, lighter weight seat occupants must normally exert a deliberate leveraged thrust or force, in addition to pulling the actuator lever, for completely extending a leg rest assembly and/or moving the seat assembly to its "reclined" position. Moreover, it is often difficult for the seat occupant to return the seat assembly to the "upright" position from the fully "reclined" position due to the relatively large included angle between the seat member and the reclined seat back. Therefore, the seat occupant must exert a relatively large and deliberate leveraged force to return the reclined seat assembly to its full "upright" position. Furthermore, in many conventional recliners, the leg rest assembly cannot be retracted to its "stowed" position from an extended or elevated position until after the seat occupant has completely returned the seat assembly to its fully "upright" position. Likewise, some reclining chairs do not permit independent actuation of the leg rest assembly during the entire range of reclining motion.

While many conventional reclining chairs operate satisfactorily, furniture manufacturers are continually striving to develop improved frames and actuation mechanisms for reducing system complexity and increasing structural soundness and smoothness of operation as well as occupant comfort. Such advanced development is particularly important for "wall proximity" reclining chairs since their actuation mechanisms are inherently more complex due to the requirement of accommodating rearward reclining movement of the seat back relative to a stationary structure. Furthermore, there is a continuing desire to develop improved fabrication and assembly techniques which will result in reduced costs while promoting increased efficiency and improved product quality.

SUMMARY OF THE INVENTION

In accordance with the principles of the present invention, an improved method for assembling a wall proximity reclining-type article of furniture is disclosed which is designed to overcome the disadvantages associated with traditional fabricating, assembling and upholstering techniques. As a related object, an improved construction for wall proximity reclining-type seating units (i.e., chairs, sofas, loveseats and the like) is disclosed which can be simply, efficiently, and rigidly assembled so as to significantly reduce its overall complexity, weight, and cost while providing improved operation and comfort to the seat occupant.

It is an additional object of the present invention to provide an improved actuation mechanism which is adapted to permit selective and independent reclining movement of a seat back relative to a seat member as well as actuation (i.e. extending and retracting) of a leg rest assembly and simultaneous tilting of the chair frame relative to a stationary base. In addition, the improved actuation mechanism is also adapted to provide means for causing translational movement of the chair frame during reclining movement of the seat assembly to maintain a generally constant clearance between the seat back and an adjacent stationary structure, such action being referred to as "wall proximity" reclining movement. As such, the improved actuation mechanism of the present invention is integrated into a wall proximity reclining/tilt chair wherein the minimal force, achieved upon shifting the weight of the seat occupant, is utilized as the primary means for moving the seat assembly between an "upright" position and a wall proximity "reclined" position.

It is another object of the present invention to reduce the input force exerted by the seat occupant for smoother operation of the actuation mechanism. As a related object, the complexity of improved actuation mechanism has been significantly simplified to incorporate mechanical linkage and drive components optimally designed for substantially reducing frictional losses so as to promote easier and smoother actuation. Moreover, the various operative linkages are designed to permit "pre-assembly" of the actuation mechanism without utilization of a conventional mechanism frame assembly.

A further object of the present invention is to provide a simplified "knock-down" frame construction which is structurally rigid, easy to assemble, and reduces lateral or "side-to-side" deflection of the chair arms. Accordingly, the integrated or "knock-down" construction of the reclining chair facilitates application of unique fabrication and assembly techniques which effectively result in increased production efficiency and cost savings while concomitantly producing a high-quality article of furniture. In general, the construction of the improved wall proximity reclining chair is such that the pre-assembled actuation mechanism cannot be divorced from the pre-upholstered frame components which, when assembled, are rigidly interconnected to define a "box-like" chair frame from which the pre-assembled actuation mechanism is integrally suspended. In this manner, the conventional construction of supporting the actuation mechanism within a separate and distinct mechanism frame assembly is no longer required. The pre-assembled actuation mechanism includes a drive rod and a front support shaft which are each directly supported between left and right upholstered side frame assemblies. As such, extremely precise alignment of the actuation mechanism with respect to each of the separate pre-upholstered frame components is possible. Moreover, front and rear cross-rail assemblies interconnect the left and right side frame assemblies to define a "unitized" and extremely rigid box-like chair frame or body for inhibiting side-to-side flexion of the actuation mechanism suspended therein as well as of the side frame assemblies themselves. In addition to the structural and functional advantages associated with the modular wall proximity reclining chair of the present invention, a unique method of assembling the pre-assembled actuation mechanism as an integrated component within the pre-upholstered frame components is disclosed.

In accordance with a preferred embodiment, the wall proximity reclining chair of the present invention includes a "three-way" actuation mechanism which can be actuated to independently "recline" in wall proximity fashion a seat back relative to a seat member of move a leg rest assembly between "retracted" and "extended" positions. In addition, tilt linkage means are provided to cause substantially concurrent "tilting" movement of the entire chair frame from a "non-tilted" to a "tilted" position upon movement of the leg rest assembly from the "retracted" position to the "extended" position, respectively. Moreover, a full range of independent "wall proximity" reclining movement of the seat back relative to the seat member is possible regardless of the operative position of the leg rest assembly between its fully "retracted" and "extended" positions. This "wall proximity" reclining movement also produces substantially concurrent horizontal translational and "tilting" movement of the chair frame. Therefore, tilting of the chair frame due to reclining movement of the seat back and tilting due to movement of the leg rest assembly are automatic, independent and cumulative in nature. Moreover, the translational movement of the chair frame is effective in maintaining a substantially constant clearance or "proximity" between the seat back and an adjacent stationary structure during the wall proximity reclining movement.

Additional objects, advantages, and features of the present invention will become apparent from the following description and appended claims, taken in conjunction with the accompanying drawings.

DESCRIPTION OF THE DRAWINGS

FIGS. 1A through 1D are perspective views of an exemplary wall proximity reclining/tilt chair shown in various operative positions, the "modular" components of which have been fabricated and assembled in accordance with the principles of the present invention;

FIGS. 7A through 7H are various perspective views provided to illustrate a preferred method for assembling the wall proximity reclining/tilt chair of FIGS. 1 and 2.

DETAILED DESCRIPTION OF THE INVENTION

Figure 2A:
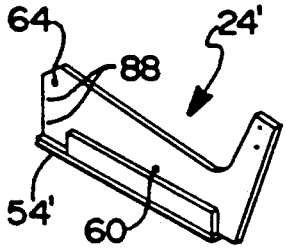
FIG. 2A illustrates a modified side frame assembly that can be utilized in alternative constructions for wall proximity reclining/tilt seating units similar to the reclining/tilt chair shown in FIG. 2.

In accordance with the teachings of the present invention, an improved actuation mechanism for use in single and multi-person articles of furniture (i.e. chairs and sofas or loveseats) is disclosed. In addition, the present invention is also directed to a method of assembling the improved actuation mechanism as a pre-assembled and "integrated" component of a wall proximity reclining-type chair or the like. As will be described, the pre-assembled actuation mechanism is uniquely suspended in a "fixed" three-pivot-point arrangement from pre-upholstered box-like frame components so as to provide precise mechanical alignment and superior structural rigidity while concomitantly facilitating application of highly efficient fabrication and assembly processes.

In the particular embodiment disclosed, the article of furniture shown is a combination wall proximity recliner and tilt chair, hereinafter referred to wall proximity reclining/tilt chair 10, which includes a pre-assembled actuation mechanism 12 and various upholstered frame components that can be quickly and simply assembled as a modular seating unit. Such "modular" construction provides a significant advancement over conventional furniture fabrication and assembly techniques since manipulation of heavy and cumbersome "unitized" chair frames during upholstery installation is no longer required. As such, each frame component or frame sub-assembly can be upholstered prior to modular assembly with actuation mechanism 12 so as to improve individual component quality as well as overall system quality and production efficiency. Moreover, since actuation mechanism 12 of the present invention is relatively compact in size, the use of loose upholstered cushions, which is an important feature in marketing various styles of chair, sofa or loveseat furniture, is also possible.

With particular reference to the drawings, the functional and structural aspects of actuation mechanism 12, as operably suspended from the various pre-upholstered box-like frame components of reclining/tilt chair 10, will now be described. More particularly, FIG. 1A depicts an exemplary wall proximity reclining/tilt chair 10 having its seat assembly 14 shown in a fully "upright/non-tilted" position with leg rest assembly 16 retracted to its "stowed" position for permitting a seat occupant to enjoy conventional seating. FIG. 1B illustrates reclining/tilt chair 10 in the "upright/tilted" position with leg rest assembly 16 being protracted to its "extended" position. As seen in FIG. 1C, seat assembly 14 includes a seat back 18 shown in a wall proximity "reclined" position relative to a seat member 20 with leg rest assembly 16 positioned in its retracted or "stowed" position. As is known, reclining movement of seat assembly 14 is accomplished by the seat occupant deliberately applying pressure to seat back 18 such that a seat swing mechanism causes seat member 20 to move forwardly and upwardly for maintaining seating comfort while the included angle increases therebetween. In addition, the entire chair frame 21 is also supported for translational movement with respect to stationary base assembly 22. Therefore, upon movement of seat assembly 14 to the "reclined" position, chair frame 21 moves forwardly for maintaining a relative constant clearance (i.e., wall proximity) between seat back 18 and an adjacent wall surface. Furthermore, chair frame 21 is rearwardly "tilted" upon the forward translational movement of chair frame 21 on base assembly 22. As such, the tilting movement of chair frame 21 due to reclining movement of seat assembly 14 is independent of, and cumulative with, the tilting movement caused upon movement of leg rest assembly 16 to its "extended" position. Thereafter, chair 10 may be easily returned to the "upright/non-tilted" position of FIG. 1A upon deliberate application of rearward pressure to seat assembly 14 or, more simply, if the seat occupant leans forward to remove pressure from seat back 18. Finally, FIG. 1D shows seat assembly 14 of chair 10 in the wall proximity "reclined/tilted" position with leg rest assembly 16 protracted to the "extended" position.

Figure 2:
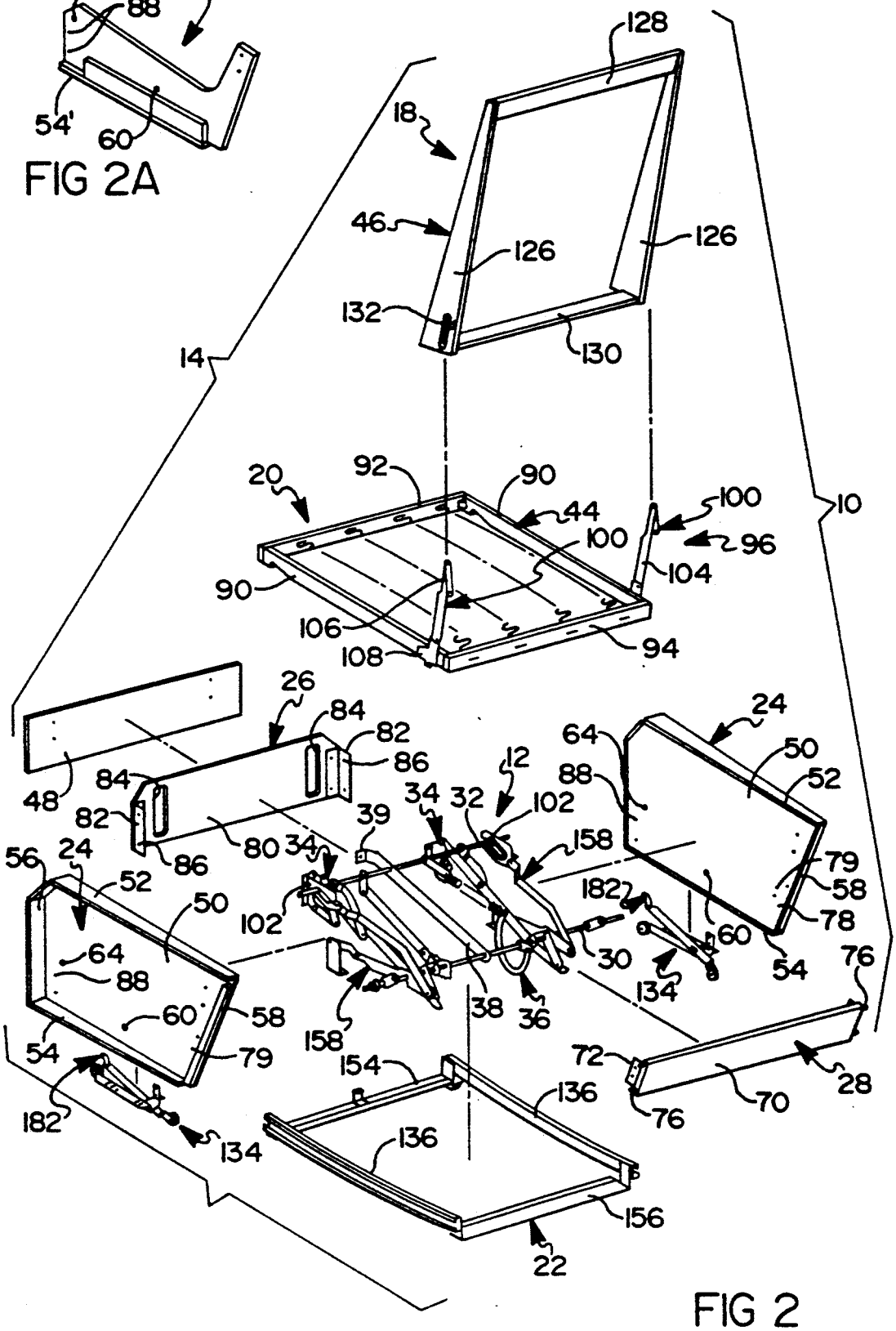
FIG. 2 is an exploded perspective view of the wall proximity reclining/tilt chair shown in FIG. 1 with its upholstery, springs and other parts removed from the pre-assembled components for illustrating their integrated and interdependent association with an improved actuation mechanism.

In accordance with the primary design features of the present invention, the various pre-assembled and upholstered frame components provided for operably suspending actuation mechanism 12 within reclining/tilt chair 10 will now be clearly described. For purposes of clarity, FIG. 2 shows the various pre-assembled frame components with their upholstery, padding, springs, etc. removed to better illustrate the interdependency of the frame components construction which can be rapidly and rigidly assembled in a relative easy and efficient manner. Therefore, all of the frame components can be individually fabricated or sub-assembled to include the requisite brackets, springs, padding and upholstery on an "off-line" batch-type basis. Thereafter, the various pre-assembled and upholstered frame components are assembled for totally integrating actuation mechanism 12 therein. In addition, while the disclosure is primarily directed hereinafter to wall proximity reclining/tilt chair 10, it will be appreciated that the novel modular construction and method of assembly taught by the present invention can be readily incorporated into wall proximity sofas, loveseats and the like.

As seen from FIGS. 2 through 5, actuation mechanism 12 of wall proximity reclining/tilt chair 10 is integrated into and operably suspended from left and right side frame assemblies 24. In addition to side frame assemblies 24, chair 10 also includes front and rear rail assemblies 26 and 28, respectively, which when interconnected define a rigid "box-like" chair frame. Preferably, most of the structural frame components such as side frame assemblies 24, front rail assembly 26, rear rail assembly 28, seat frame 44, seat back frame 46 and leg rest frame board 48 are each constructed in a manner which enables them to support springs, padding, upholstery, etc. in order to complete a decorative and stylish reclining/tilt chair 10 similar to that shown in FIGS. 1A through 1D. More preferably, each of these frame components is fabricated from one or more wood panels and/or rails that are fixedly secured together by suitable fasteners, such as dowels, staples, nails and screws, and which may be reinforced at critical joints by metal reinforcement plates or brackets and/or wood corner blocks in a known manner. As previously noted, each frame component is individually pre-assembled for subsequent modular assembly into wall proximity reclining/tilt chair 10. However, it is to be understood that the specific construction shown for each frame component is merely exemplary in nature.

With continued reference to FIGS. 2 through 5, actuation mechanism 12 is shown to include a drive rod 30 and front support shaft 32, both of which are spatially oriented to be precisely located and "suspended" from left and right side frame assemblies 24. In addition, leg rest assembly 16 is supported for extensible movement on actuation mechanism 12. More specifically, leg rest assembly 16 includes left and right pantograph linkage mechanisms 34 and a spring-assisted toggle mechanism 36 which are operably associated with drive rod 30 and front support shaft 32 for permitting the seat occupant to selectively actuate leg rest assembly 16. A rigid cross-brace 38 is centrally located between side frame assemblies 24 and is secured between drive rod 30 and support shaft 32 for providing structural rigidity within actuation mechanism 12. Preferably, one end of cross-brace 38 is journally supported on drive rod 30 while the opposite end thereof is configured as a bracket 39 which is fixedly secured (such as by a suitable threaded fastener) to an inner surface of front rail assembly 26. Furthermore, support shaft 32 is fixed to an intermediate portion of cross-brace 38 via a spacer clip 40 to inhibit rotation of support shaft 32 upon rotation of drive rod 30. Spacer clip 40 also serves to locate support shaft 32 relative to side frame assemblies 24. In the preferred construction, drive rod 30 is an elongated square shaft having a handle portion 42 (FIG. 1) provided adjacent an upholstered exterior portion of one of side frame assemblies 24 that can be easily reached by a person seated in chair 10 for convenient actuation thereof.

Left and right side frame assemblies 24 are each constructed as rigid, roughly rectangular frame components having a universal side panel 50 and horizontal bottom and top members 52 and 54, respectively, with top members 54 also functioning as chair arms. Each side frame assembly 24 also includes a front post 56 which preferably has at least a lower portion substantially perpendicular to the floor. In addition, each side frame assembly 24 has an inclined rear post member 58 such that front and rear posts 56 and 58, respectively, and top and bottom horizontal members 54 and 52, respectively, are each rigidly secured to a side panel 50. Moreover, side panels 50 have a first set of aligned bores 60 formed therein that are sized to receive opposite ends of drive rod 30. In addition, sleeve journals 62 are retained within bores 60 and are sized to permit rotation of drive rod 30 therein. As such, aligned bores 60 define a first set of "fixed" pivot or suspension points that are seated directly within side panels 50. In this manner, drive rod 30 has a fixed pivot arrangement and not a conventional "floating" type which typically required additional linkages.

Side panels 50 also include a second set of aligned bores 64 oriented to receive opposite ends of support shaft 32 therein. As previously noted, spacer clip 40 positively locates rigid cross-brace 38 with respect to support shaft 32 for maintaining the desired orientation and "side-to-side" positioning of support shaft 32. As such, aligned bores 64 are seated directly in side panels 50 to define a second set of "fixed" pivot or suspension points. Since the first and second sets of aligned bores 60 and 64, respectively, are oriented in a predetermined arrangement on side panels 50, it is apparent that all critical hole locations for left and right side panels 50 may be drilled in a single operation. Therefore, pre-assembly of actuation mechanism 12 facilitates "final" assembly of chair 10 since drive rod 30 and support shaft 32 are oriented for receipt within aligned bores 60 and 64, respectively. Side panels 50 do not become "left" or "right" until the members 52, 54, 56, and 58 are affixed, sleeve journals 62 are installed in aligned bores 60, and T-nuts are inserted within bores 79 (described below). Thus, by fabricating side panels 50 as a universal component, the accuracy of locating aligned bores 60 and 64 is greatly enhanced.

With particular reference to the exploded perspective view of FIG. 2, means for rigidly securing front and rear rail assemblies 26 and 28, respectively, to side frame assemblies 24 for integrally suspending actuation mechanism 12 within a rigid "box-like" chair frame is disclosed. More particularly, rear rail assembly 28 includes a laterally extending cross-member 70 and left and right angled brackets 72 secured to the inner face surface thereof. One or more locator pins or dowel pins 76 provided on the opposite ends of cross-member 70 are adapted to be inserted into corresponding sets of aligned locator holes 78 formed in side panels 50 for properly locating rear rail assembly 28 with respect to side frame assemblies 24. Thereafter, suitable fasteners are used for fixedly securing angled brackets 72 and, in turn, rear rail assembly 28 directly to the inner surface of side panels 50. Preferably, T-nuts are retained within bores 79 formed in side panels 50 for receiving threaded fasteners therein to rigidly secure angled brackets 72 and, in turn, rear rail assembly 28 between the left and right side frame assemblies 24. Typically, an upholstered rear "tailgate" (not shown) is stapled to rear cross-member 70 since cross-member 70 is not generally upholstered.

Front rail assembly 26 includes a laterally extending planar front cross-member 80 and angled brackets 82 that are secured in close proximity to its opposite lateral ends. As will be appreciated, front cross-member 80 includes enlarged apertures 84 which are sized to permit leg rest pantograph linkages 34 to move therethrough during extension and retraction of leg rest assembly 16. In addition, front cross-member 80 is upholstered prior to assembly between side frame assemblies 24. Angled brackets 82 include bores 86 which are alignable with bores 88 formed in side panels 50 to permit front rail assembly 26 to be rigidly secured between left and right side frame assemblies 24. In a preferred construction, suitable self-tapping threaded fasteners are used which are inserted into bores 88 from the outside of side panels 50. Front cross member 80 is considerably deeper in top to bottom dimension than front frame members utilized in many conventional recliner chairs. This increased dimension provides a substantially broader surface for connection of the front rail assembly 26 to side frame assemblies 24. When assembled, this increased lateral connection surface and box-like construction results in a very rigid chair frame. In addition, the enlarged connection surface enhances the rigidity of the chair arms thereby significantly reducing any deflection of the arms due side-to-side pressure applied thereagainst.

Figure 5:
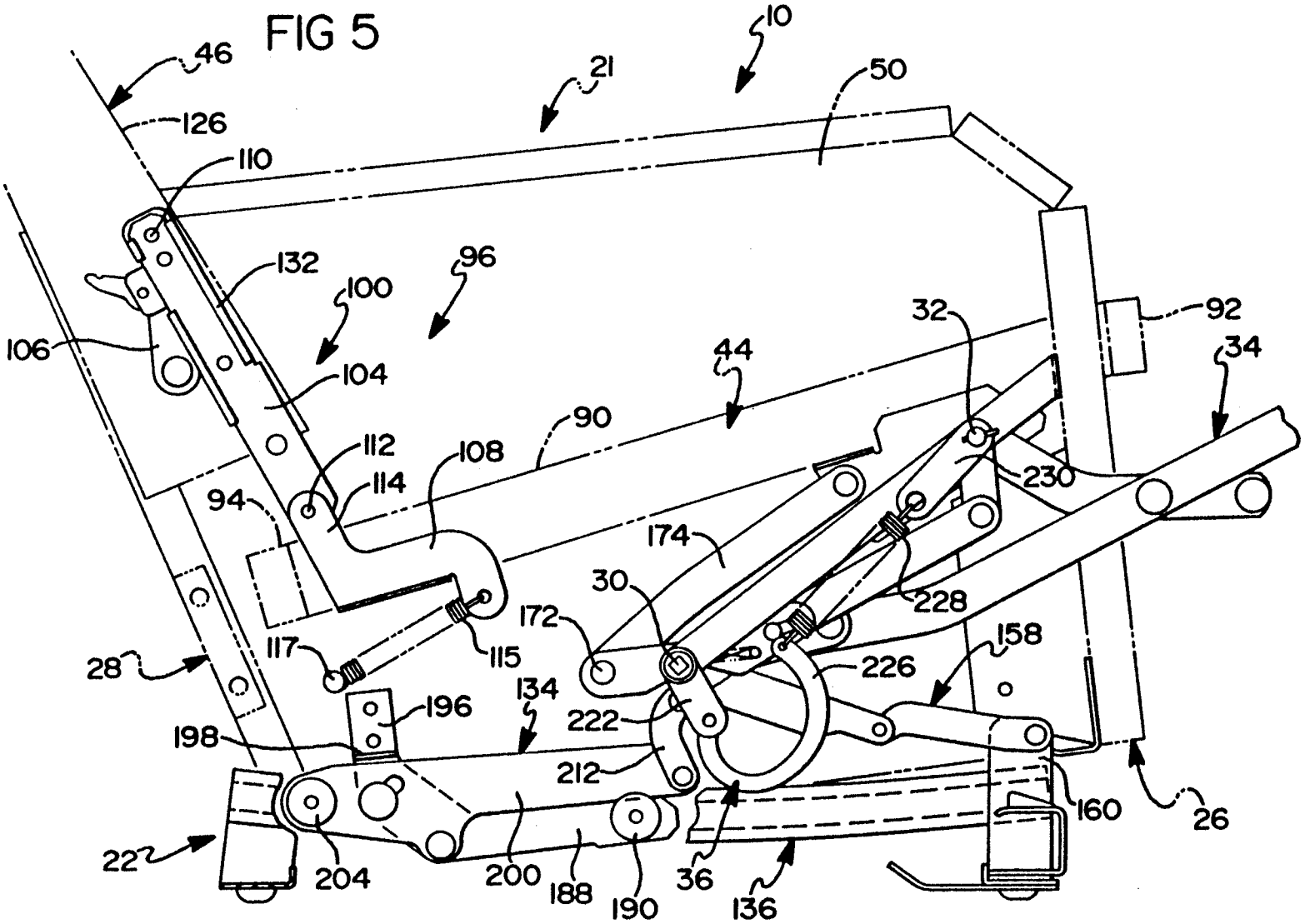
FIG. 5 is a sectional view illustrating the wall proximity reclining/tilt chair in a "leg rest extended/tilted" position.

As best seen in FIGS. 2 and 5, seat frame 44 is located between and supported for reclining movement on side frame assemblies 24. More specifically, seat frame 44 is a rigid rectangular structure having left and right side bars 90 which are rigidly secured to opposite ends of front and rear cross pieces 92 and 94, respectively. In view of the compact nature of actuation mechanism 12, seat frame 44 is non-contoured (i.e. "flat") which also permits use of loose cushions, if desired. Seat frame 44 is supported for movement relative to side frame assemblies 24 by means of a seat swing mechanism 96 for causing seat frame 44 to move substantially horizontally and slightly up or down, depending on whether seat frame 44 moves forwardly (during "reclining" movement) or rearwardly (on return to the "upright" position). Seat swing mechanism 96 includes left and right hand rear swing linkages 100 and left and right hand front slide brackets 102. Rear swing linkages 100 extend vertically well above the level of seat frame 44 along rear posts 58 of side frame assemblies 24. Each rear swing linkage 100 includes an elongated swing link 104, a support bracket 106 and a seat bracket 108. An upper end of each swing link 104 is pivotably connected just below chair arm 54 to support bracket 106 which, in turn, is fixedly secured to its corresponding side panel 50. As such, pivot points 110 between swing links 104 and support brackets 106 define a third set of "fixed" pivot or suspension points that are seated directly in side panels 50.

The lower end of each rear swing link 104 is pivoted about a pivot point 112 to an upstanding post section 114 of seat bracket 108. Seat bracket 108 has a horizontal flange portion that is securely fixed (such as by wood screws) to an underside surface of a seat side bar 90 in relatively close proximity to the back end of seat frame 44. As such, loading on the rear of seat frame 44 passes from seat brackets 108 and pivots 112 into rear swing links 104 as tension loading which is transferred by way of pivots 110 and support brackets 106 into side frame assemblies 24 of chair 10. Rear swing links 104 are elongated to provide increased leverage for balanced reclining action. Thus, the rear of seat frame 44 moves much like a controlled pendulum on and below upper pivots 110. As will be appreciated, the particular length of rear swing links 104 and the position of pivot point 110, can be selectively varied to compensate for increased frictional resistance due to upholstery of the reclining seat assembly 14 rubbing against stationary upholstery. While not considered necessary to provide superior balanced comfort, left and right tension springs 115 may be installed between seat bracket 108 and a rearward stationary chair frame component, such as locator pin 117, to provide augmented resistance to reclining movement of seat assembly 14.

As mentioned, seat swing mechanism 96 also includes a pair of (i.e. left and right) front slide brackets 102 which are operable to guide and limit fore and aft movement of seat frame 44 and, in turn, seat member 20. As best seen from FIGS. 3 and 4, the opposite ends of front support shaft 32 extend through lost-motion slots 116 formed in left and right slide brackets 102 which have horizontal flanges 118 securely fixed (such as by wood screws) to an underside surface of seat side bars 90 in relatively close proximity to the front end of seat frame 44. In addition, slide brackets 102 also include elongated vertical flanges 119 which are adapted to be retained against the inner side surface of seat side bars 90. As will be appreciated, the angularity and length of slots 116 define the range of fore and aft movement of seat frame 44 relative to chair body 21 upon the seat occupant applying a force to move seat assembly 14 between the "upright" and "reclined" positions. In addition, means are also provided for limiting the amount of frictional drag upon movement of seat frame 44 with respect to support shaft 32. In particular, a nylon insert 120 is fixedly retained within each lost-motion slot 116. Nylon insert 120 is operable for minimizing friction resistance to movement of the front end of seat member 20 with respect to support shaft 32 while concomitantly acting to effectively dampen noise. A pair of elongated spacer clips 122 are provided on opposite ends of support shaft 32 for biasing disk-like washers 124 into alignment with an inner surface of nylon inserts 120 adjacent slots 116. In addition, dish-like washers 124 and elongated spacer clips 122 serve to align seat frame 44 in a "side-to-side" manner. Elongated spacer clips 122 also act to positively locate and retain pantographic leg rest linkages 34 on support shaft 32. Therefore, slide brackets 102, nylon inserts 120, disk-like washers 124, and elongated spacer clips 122 are pre-assembled onto support shaft 32.

With particular reference again to FIG. 2, the construction of seat back 18 is shown to include a seat back frame 46 that is in the form of a rigid relatively rectangular assembly. Seat back frame 46 includes right and left hand side members 126 and upper and lower crosspieces 128 and 130, respectively. As is known, seat back frame 46 can be removably mounted on an upper portion of rear swing links 104 by means of slide brackets 132 secured at suitable locations on side members 126. A preferred construction of slide brackets 132 for this type of mounting is shown and described in U.S. patent application Ser. No. 07/816,849, filed Jan. 2, 1992 and entitled "Detachable Chair Back Brackets", and which is assigned to the common assignee of the present invention. In general, slide brackets 132 are channel-shaped to provide an interior track that slidably receives rear swing links 104 therein. When slide brackets 132 are mounted on rear swing links 104, seat back 18 is, in effect, an extension of rear swing links 104 above pivot points 110. As such, seat back 18 can be pivoted about pivot points 110 for causing relatively easy angularly movement of rear swing links 104. The primary means of moving rear swing links 104 is the application of pressure against seat back frame 44 above the level of pivot point 110, as when the seat occupant leans backward in seat assembly 14. As will be described hereinafter, this action causes seat back frame 44 to pivot backwardly for causing rear swing links 104 to swing forwardly for initiating rolling forward movement of left and right wheeled bearing link assemblies 134 in curved tracks 136 on base assembly 22. Since bearing link assemblies 134 are secured to chair frame 21, such action results in chair frame 21 moving forward and tilt on base assembly 22.

As best seen from FIGS. 2 and 5, leg rest assembly 16 includes frame board 48 having an outer surface that is padded and upholstered so that upon completion, wall proximity reclining/tilt chair 10 will be as seen in FIGS. 1A through 1D. Frame board 48 is supported and moved by identical left and right hand pantograph linkages 34. Pantograph linkages 34 are substantially identical in function and structure to that shown in FIG. 3 of U.S. Pat. No. 3,096,121, assigned to the common assignee of the present invention, with the exception that pantograph linkages 34 are operably suspended about the second set of "fixed" suspension points defined by support shaft 32. Such a suspension arrangement for leg rest assembly 16 is clearly shown and described in U.S. patent application Ser. No. 07/819,784, which has been previously incorporated by reference herein. The extensible action of leg rest assembly 16 takes place simultaneously for both the left hand and right hand pantograph linkages 34 when there is sufficient angular rotation of drive rod 30 via handle 42. In this manner, frame board 48 is moveable between its "stowed" vertical position and its "extended" horizontal position.

Figure 3:
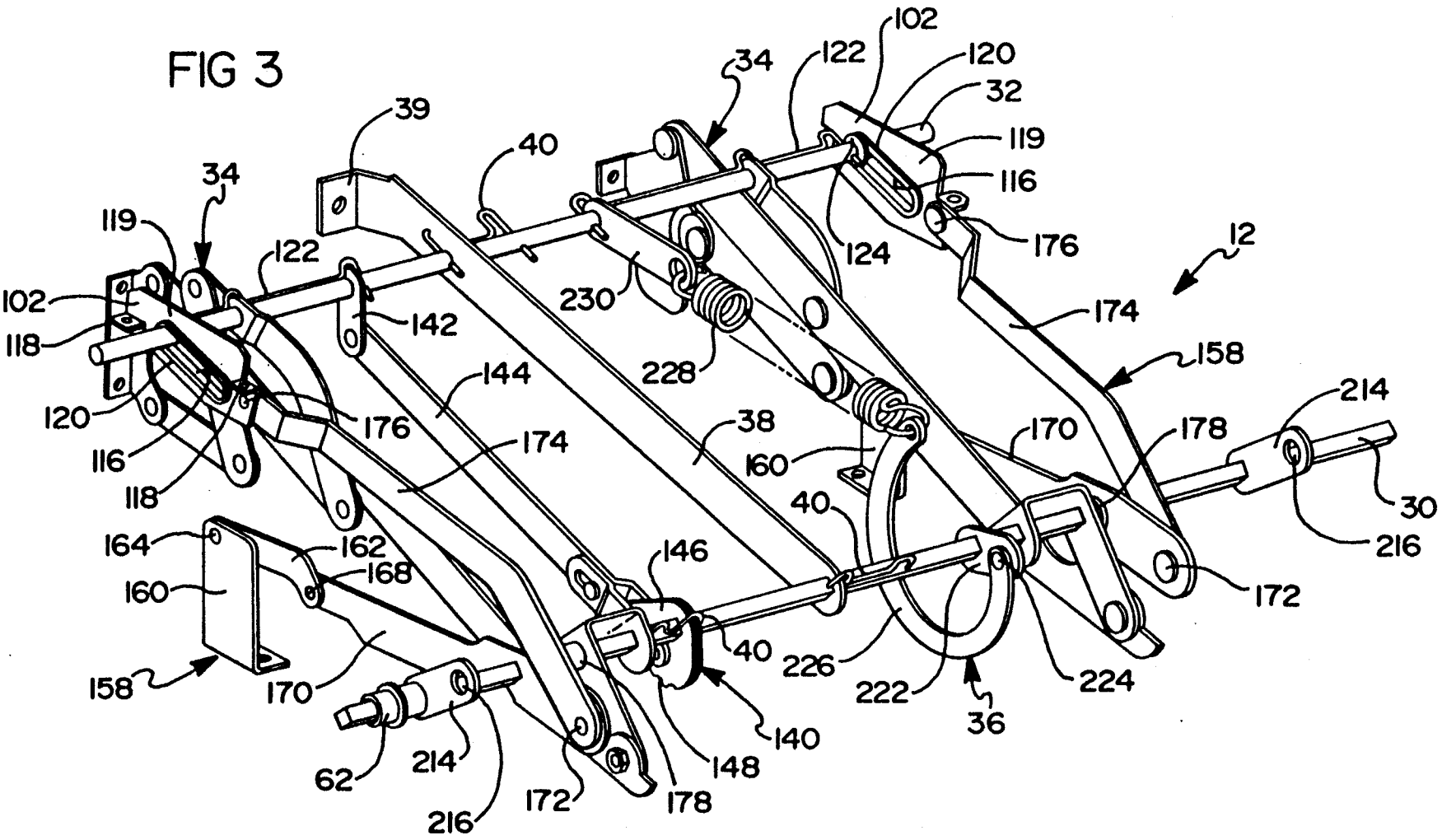
FIG. 3 is an enlarged perspective view of the improved actuation mechanism shown in FIG. 2.
Figure 4:
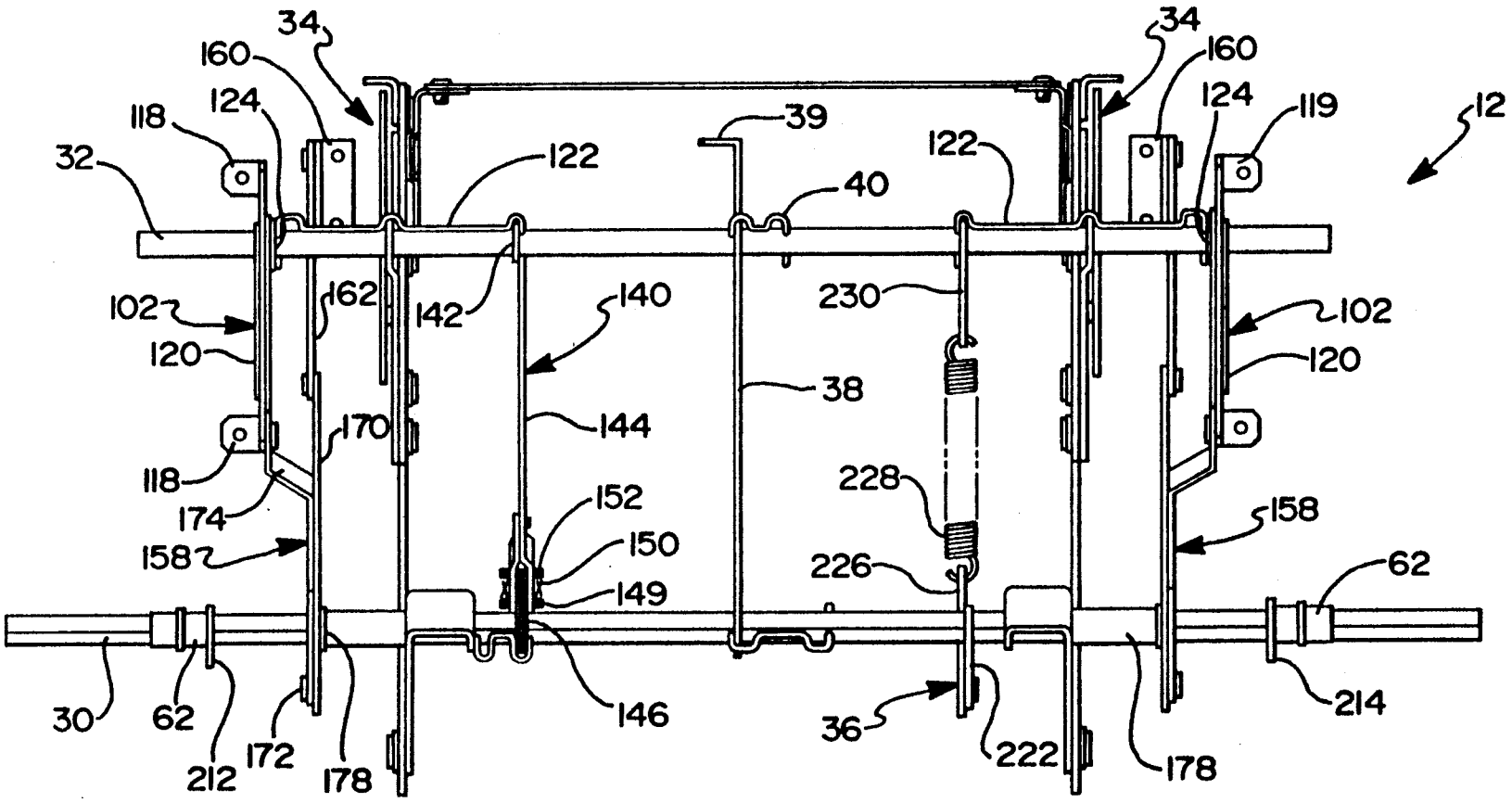
FIG. 4 is a plan view of the improved actuation mechanism shown in FIG. 3.

According to the embodiment shown, a ratchet-type detent mechanism 140 interconnects drive rod 30 and support shaft 32 for providing various intermediate locked positions for leg rest assembly 16. The structure of ratchet mechanism 140 includes a short link 142 having a first end journalled on support shaft 32. As seen in FIGS. 3 and 4, spacer clip 122 maintains proper spacing on support shaft 32 between left side bracket 102, left pantograph linkage 34 and short link 142. The lower end of short link 142 is pivotably coupled to a first end of an inclined link 144. The other end of inclined link 144 is bifurcated to receive a sector-shaped plate member 146 that is mounted by way of a square hole on drive rod 30 so as to rotate therewith. Ratchet plate 146 has specially shaped recesses 148 in its outer periphery which act as ratchet means cooperating with a floating detent pin 149 carried by the bifurcations and urged into recesses 148 by tension springs 150 anchored on a pivot pin 152 between plate 146 and inclined link 144. When drive rod 30 is rotated to operate leg rest assembly 16, plate 146 is also rotated to expose different recesses 148 to the detent pin depending upon the degree of rod rotation and the elevation. When the detent pin is lockingly biased into one of recesses 148, leg rest assembly 16 is yieldably locked in an elevated position against inadvertent angular movement by mechanism 140. Furthermore, leg rest assembly 16 can only be returned to its "stowed" position from an intermediate position by fully protracting leg rest assembly 16. Thereafter, reverse rotation of handle 42 cause pantograph linkages 32 to return to their "stowed" position.

In accordance with another feature of the present invention, left and right push link mechanisms 158 are provided which work in conjunction with seat swing mechanism 96 for causing translational "fore and aft" movement of bearing linkage assemblies 134 and, in turn, chair frame 21 relative to base assembly 22 in response to the pressure applied by the seat occupant to seat back 18. In general, push link mechanisms 158 are interconnected between front cross bar 154 of base assembly 22 and a forward portion of seat frame 44. More particularly, base brackets 160 are fixed to extend vertically from front cross member 154 of base assembly 22 such that a first end of lower push links 162 are pivotally connected at pivot 164 to an upper end of base brackets 160. The opposite end of lower push links 162 are pivotally connected at pivots 168 to a first end of drive rod swing links 170 which are journally supported on drive rod 30. The opposite end of drive rod swing links 170 are pivotally connected at pivot 172 to the lower end of offset upper pull links 174, the upper ends of which are pivotally connected at pivot points 176 to the respective front slide brackets 102 mounted on side bars 90 of seat frame 44. Preferably, drive rod swing links 170 have an aperture through which a spacer sleeve 178 is disposed and which is concentrically supported on square drive rod 30. Thus, square drive rod 30 fixes the longitudinal position of drive rod swing links 170 and upper pull links 174 but is independently operable with respect to angular movement thereof. As such, when pressure is applied by the seat occupant to move seat assembly 14 between the "upright" position and the "reclined" position, push link mechanisms 158 cause corresponding fore and aft translational movement of chair frame 21 via movement of bearing linkage assemblies 134 within curved tracks 136. In addition, the slight curvature of tracks 136 cause chair frame 21 to tilt rearwardly relative to the floor upon forward translational movement thereof.

For purposes of clarity, the term "tilting" refers to angular movement of chair frame 21 and, in turn, seat assembly 14 about a horizontal axis relative to base assembly 22. Such "tilting" movement occurs substantially concurrently with protraction of leg rest pantograph linkages 34 via selective rotation of actuator lever 42 by the seat occupant and/or upon reclining movement of seat assembly 14. Wall proximity "reclining" refers generally to the concurrent angular movement of seat assembly 14 relative to chair frame 21 and the translational movement of chair frame 21 relative to base 22 for maintaining a relatively constant clearance between the seat back 18 and the adjacent structure or wall surface. Moreover, the present invention is designed to permit the seat occupant to select and maintain virtually any desired reclined position within the entire range of reclining movement between the "upright" and fully "reclined" positions.

With particular reference now to FIGS. 3 through 6, the primary components of actuation mechanism 12 which produce the above-noted tilting movement characteristics will now be described in more detail. As noted, actuation mechanism 12 includes left and right wheeled bearing link assemblies 134 provided for movably supporting chair frame 21 for translational "fore and aft" movement relative to curved tracks 136 of base assembly 22. Moreover, the fore and aft movement of chair frame 21 causes substantially simultaneous corresponding reclining movement of seat assembly 14 and tilting movement of chair frame 21. In addition, wheeled bearing link assemblies 134 are respectively coupled to left and right tilt linkage mechanisms 182 for causing independent tilting movement of chair frame 21 upon corresponding actuation of leg rest assembly 16 via rotation of drive rod 30. As will be appreciated, upon raising leg rest assembly 16 to an intermediate position, such as by detent mechanism 140, tilt linkage mechanisms 182 only produce a proportional amount of tilting movement.

Figure 6A:
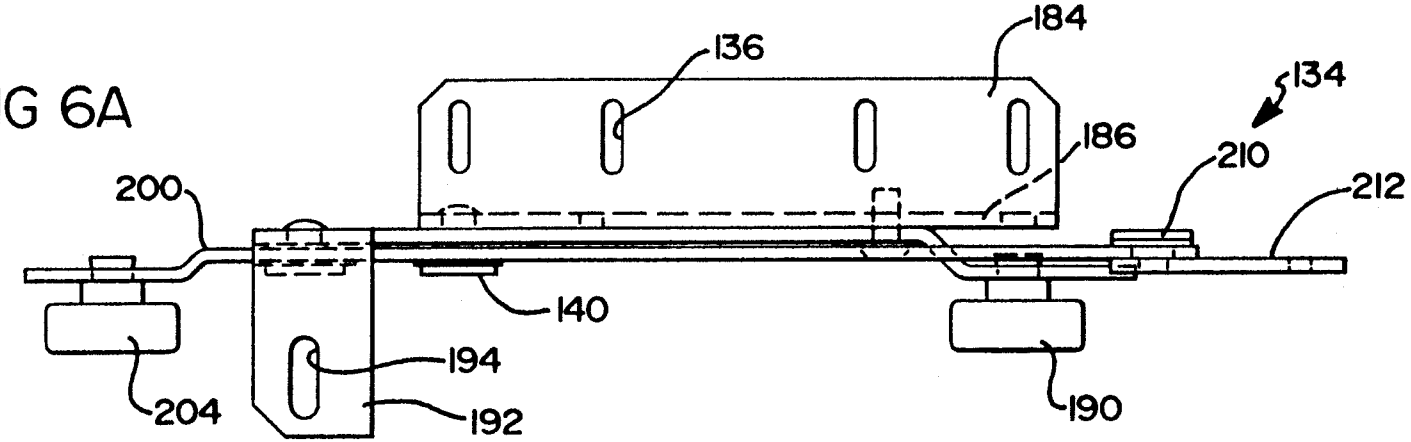
FIGS. 6A and 6B are enlarged plan and side views, respectively, of the left hand bearing link assembly shown in FIG. 2.
Figure 6B:
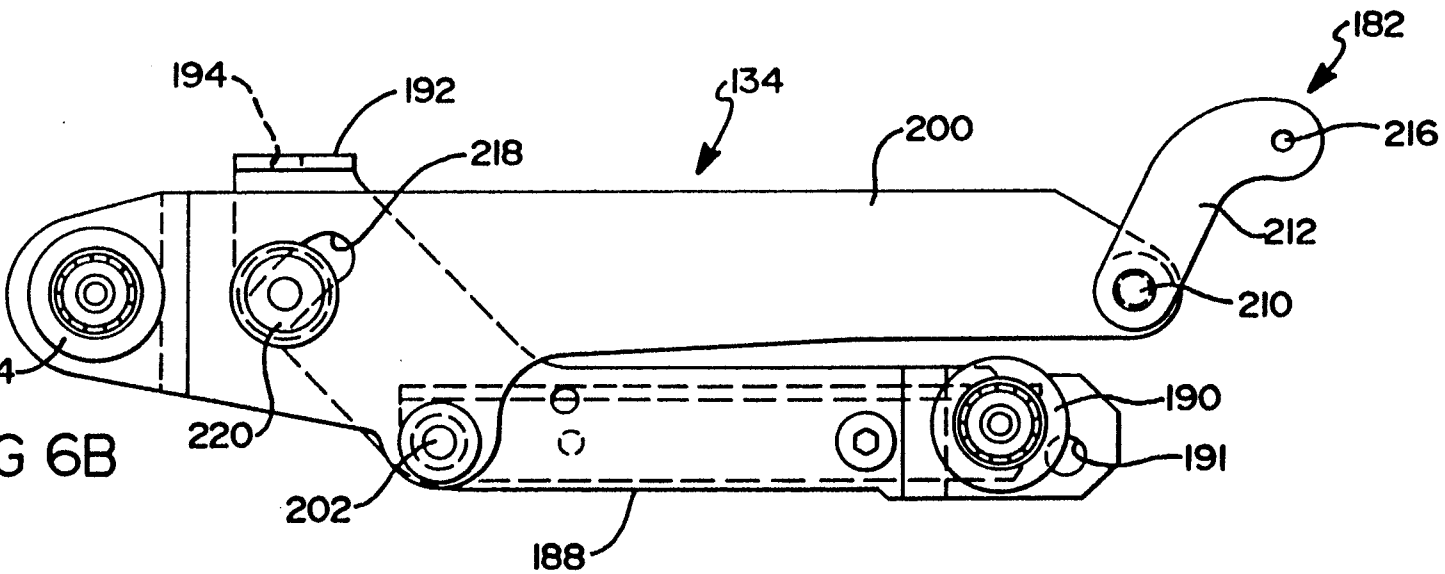

Left and right bearing link assemblies 134 are mirror-imaged wheeled assemblies disposed respectively for rolling movement in left and right curved tracks 136 of base assembly 22. Preferably, curved tracks 136 are secured at opposite ends to front and rear cross bars 154 and 156, respectively, of base assembly 22. More preferably, curved tracks 136 are aligned in parallel relationship and are slightly downwardly curved from back to front to generate a "balanced" rolling movement of the wheeled units therein. As best seen in FIGS. 6A and 6B, bearing link assemblies 134 each include an angled bracket 184 adapted to be securely affixed directly to the bottom edge surface of horizontal bottom members 52 of chair frame 21 such as by wood screws. Each bearing link flange 184 is fastened to bottom member 52 to support the weight of chair frame 21 and the seat occupant without producing sheer forces on the fasteners. Angled bracket 184 includes a downwardly extending flange 186 connected to a bearing link member 188 having a forward wheeled rolling unit 190 supported thereon and which is adapted to be rollingly disposed within tracks 136. Alternatively, front wheeled rolling unit 190 can be secured to lower mounting aperture 191 to tilt chair frame 21 in a slightly rearward orientation when in the "upright" position. The upper rear end of bearing link 188 has a right-angled flange 192 having at least one elongated slot 194 provided for securely attaching bearing link 188 to an angled bracket 196 (FIG. 5) which is secured to an inner vertical surface of side panel 50. Angled bracket 196 has a horizontal flange 198 on which are formed a series of aligned apertures (not shown). Accordingly, elongated slot 194 on bearing link flange 192 and the apertures formed in angled bracket 196 permit selective side-to-side adjustment of bearing link assemblies 134 to compensate for manufacturing tolerances in base assembly 22 and/or chair frame 21. A pivot lever 200 is pivotally connected to bearing link 188 and angled bracket 184 about pivot point 202. More particularly, pivot lever 200 includes a second rear wheeled unit 204 rolling disposed in tracks 136 with the opposite end of pivot levers 200 secured to respective left and right "tilt" linkages 182, the structure and operation of which will be described hereinafter. Therefore, the weight of the seat occupant and the center of gravity of seat assembly 14, defined by the orientation of front and rear wheeled units 190 and 204 disposed within curved tracks 136, combine to generate a forwardly directed force on bearing link assemblies 134 which tends to augment the limited occupant input (i.e., pressure to seat back 18) required for causing smooth operation of actuation mechanism 12.

With continued reference to FIGS. 6A and 6B, each bearing link assembly 134 is shown to be operatively coupled to tilt linkage mechanism 182 for "tilting" chair frame 21 relative to the floor upon movement of leg rest assembly 16. In general, tilt linkage mechanisms 182 interconnect pivot levers 200 of bearing link assemblies 134 to drive rod 30. More particularly, the forwardmost end of pivot levers 200 extend below and are generally aligned with the axis of drive rod 30 and are pivotally connected at pivot 210 to a lower end of a J-shaped toggle link 212. The other end of J-shaped toggle link 212 is pivotally connected to a connector link 214 at pivot point 216 and which, in turn, is secured on drive rod 30 for angular movement therewith. Preferably, connector link 214 is pre-assembled onto drive rod 30 such that final connection to toggle link 212 and, in turn, bearing link assemblies 134 can be accomplished during modular assembly of chair 10.

In operation, tilt linkage mechanisms 182 inhibit tilting movement of chair frame 21 until actuator lever 42 and, in turn, drive rod 30 are rotated for causing pivotal movement of pivot levers 200 relative to bearing links 188. More particularly, pivot levers 200 are formed with a lost motion slot 218 through which a rivet 200, extending through bearing link 188, moves to define a limited range of angular movement between pivot levers 200 and bearing links 188. Therefore, upon rotation of drive rod 30, the corresponding rotation of connector link 214 cause toggle link 212 to drive the forward end of pivot levers 200 downwardly. At this point, the mechanical advantage of tilt linkage mechanisms 182 act to forwardly drive J-shaped toggles 212 around and below drive rod 30 so as to permit pivot levers 200 to pivot about pivot points 202 such that bearing link assemblies 134 and, in turn, chair frame 21 are "tilted" relative to tracks 136. In addition, rivets 220 provide structural support to chair 10 for maintaining the alignment and rigidity of pivot levers 200 for causing rear wheeled units 204 to run straight within tracks 136. As such, lateral (i.e., side-to-side) cross-members can be eliminated since the rigidity of chair frame 21 is used to maintain correct wheel alignment relative to track 136.

With reference to FIG. 3, an exemplary construction for spring-assist toggle assembly 36 is shown which works coactively with leg rest pantograph linkages 34 for securely holding frame board 48 of leg rest assembly 16 in a fully retracted position against front rail assembly 26. Toggle assembly 36 is also operable to supply a spring force for biasingly urging leg rest assembly 16 toward one of its extended and retracted positions. Toggle assembly 36 includes a toggle lever 222 with a square hole which is mounted by means of the square hole on square drive rod 30 for rotation therewith. Toggle lever 222 is pivotally connected at pivot 224 to rear leg of a C-shaped toggle link 226 that curves around, under and toward the front of drive rod 30 where its front leg has an opening to which one end of a helical coil spring 228 is attached. The opposite end of spring 228 is attached to a spring connection link 230 which is journally secured by means of a circular aperture to support shaft 32. In this manner, toggle assembly 36 can be completely preassembled as part of actuation mechanism 12. The location of pivot 224 above drive rod 30 and the line of action of spring 228 are such that in the retracted position of leg rest assembly 16, the spring force acts to biasingly hold or "retain" leg rest assembly 16. As leg rest 16 is initially extended upon slight rotation of actuator lever 42 and, in turn, drive rod 30, pivot 224 moves down and over center of an imaginary line between the axis of the support shaft 32 and the drive rod axis. Once pivot 224 is over-center, tension loading on spring 228 assists in drivingly rotating drive rod 30 for elevating leg rest assembly 16 as the forward leg of link 226 is pulled toward spring connection link 230 and support shaft 32. In addition, spring 228 assists the seat occupant in pivoting handle 42 through the required actuation angle. More particularly, connection of spring-assist toggle assembly 36 between support shaft 32 and drive rod 30 places the spring force in close alignment to cross brace 38 minimizing deflection of drive rod 30 due to spring force which, in turn, causes easier handle rotation. In similar fashion, toggle assembly 36 is adapted to utilize the spring biasing force of spring 228 to assist in returning leg rest assembly 16 to its stowed position upon reverse rotation of handle 42. While not shown, tension adjustment means may be optionally provided for adjusting the tension in spring 230. The spring connection link 230 of toggle assembly 36 is positively located on support shaft 32 by means of elongated spacer clip 122 for maintaining the desired spacing between toggle assembly 36, pantograph linkage 34 and front slide bracket 102.

In accordance with the principles of the present invention, a unique method for assembling the various "modular" pre-assembled frame components and actuation mechanism 12 into reclining/tilt chair 10 will now be described in greater detail. In addition, the improved method of the present invention permits sequential assembly of the pre-assembled and/or upholstered components in a simple and efficient manner for significantly reducing overall system complexity, weight, and cost while promoting superior quality and reliability.

Figure 7A:
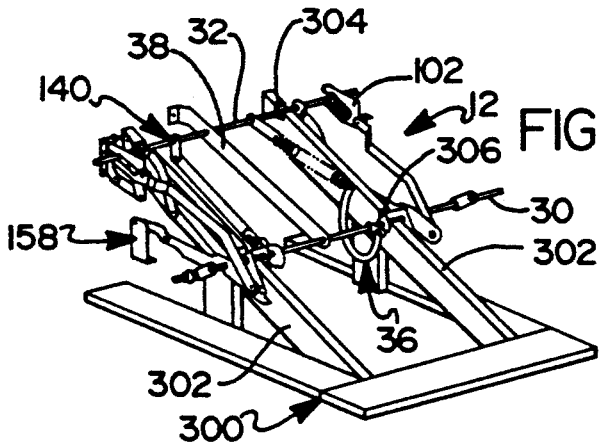

With particular reference now to FIG. 7A, pre-assembled actuation mechanism 12 is shown retained on a suitable holder or "jig" 300. Jig 300 includes a pair of spaced and angularly extending stantions 302 having first and second sets of aligned notches 304 and 306, respectively. As can be seen, the first set of aligned notches 304 is provided for retaining support shaft 32 therein while the second set of aligned notches 306 is provided for retaining drive rod 30 therein. As previously noted, the various components associated with slide brackets 102, pantograph linkages 34, push link mechanisms 158, cross-brace 38, ratchet mechanism 140 and toggle assembly 36 are all operably coupled to, or suspended from, actuation mechanism 12 prior to interconnection with the various frame components. Alternatively, jig 300 may be used as an appropriate situs for assembling the various linkages and components associated with actuation mechanism 12.

Figure 7B:
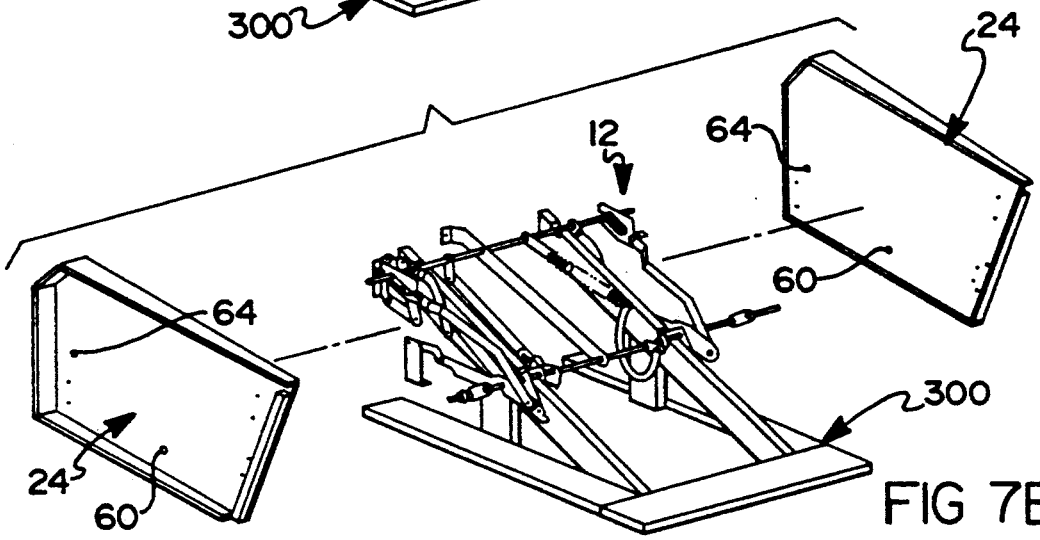

With reference now to FIG. 7B, the assembly step for orienting and interconnecting side frame assemblies 24 with actuation mechanism 12 is clearly shown. While not shown, it is to be understood that the requisite padding, lining, decorative upholstery and the like have also been installed on side frame assemblies 24 prior to assembly with actuation mechanism 12. As seen, drive rod 30 and support shaft 32 are of sufficient length such that side frame assemblies 24 can be retained thereon. More specifically, the upholstered side frame assemblies 24 are positioned on actuation mechanism 12 such that the opposite end of drive rod 30 extend through the first set of aligned bores 60 formed in side panels 50 (i.e., the first set of "fixed" pivot points). Similarly, the opposite ends of support shaft 32 are seated with the second set of aligned bores 64 formed in side panels 50 (i.e. the second set of "fixed" pivot points).

Figure 7C:
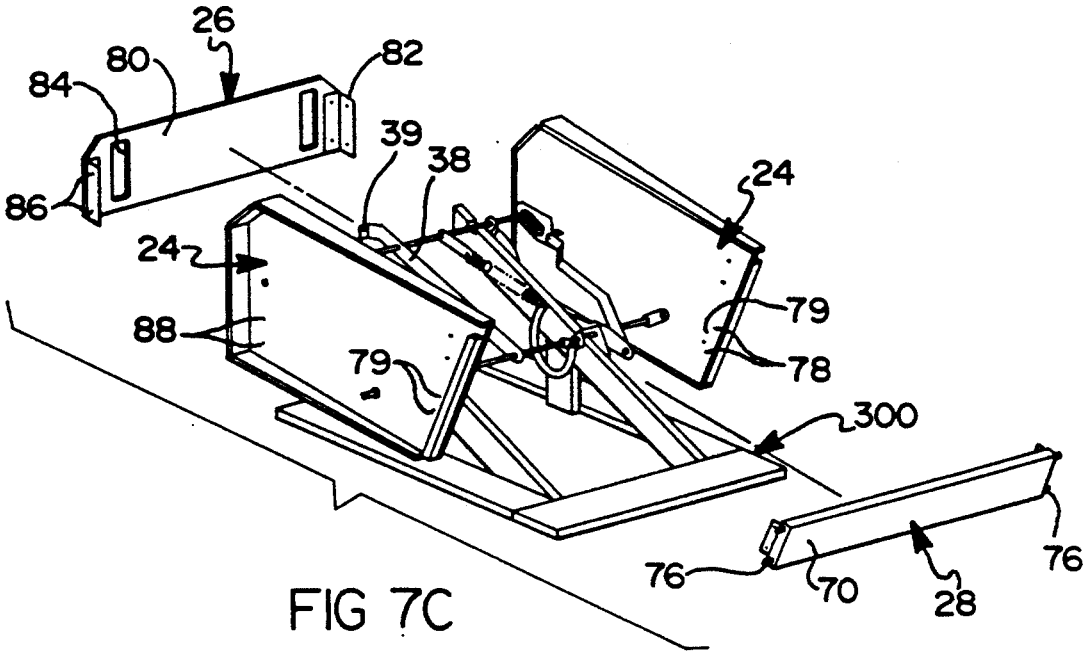

As seen in FIG. 7C, the four primary pre-assembled frame components include left and right side frame assemblies 24 and front and rear rail assemblies 26 and 28, respectively. In accordance with a preferred assembly procedure, dowel pins 76 on opposite ends of rear cross-member 70 are inserted with glue into locator holes 78 formed in side panels 50 for properly aligning and locating rear rail assembly 28 with respect to the left and right side frame assemblies 24. Thereafter, threaded fasteners are threadably driven through bores in angled bracket 72 and into T-nuts retained within bores 79 formed of side panels 50 for securing rear rail assembly 28 between the left and right side frame assemblies 24. Complete tightening of the threaded fasteners is typically deferred until front rail assembly 26 has also been secured to side frame assemblies 24. As noted, an upholstered "tailgate" (not shown) may be secured to rear rail assembly 28 in those applications wherein rear rail assembly 28 is not upholstered.

Following interconnection of rear rail assembly 28, the front rail assembly 26 is slid inwardly between left and right side frame assemblies 24 in such a manner to permit portions of pantograph linkages 34 to project through apertures 84 formed in front cross-member 80. As shown in FIG. 7C, angled brackets 82 have been pre-assembled to the rear surface at the laterally outer ends of front cross-member 80. In addition, front cross-member 80 has been upholstered prior to assembly. Self-tapping fasteners are threadably driven through tight bores 88 formed in side panels 50 into non-threaded bores 86 formed in angled brackets 82 for rigidly securing front rail assembly 26 to side frame assemblies 24. Thereafter, cross-brace bracket 39 is securely attached to front cross-member 80 to provide additional structural rigidity.

Figures 7D, 7E, 7F:
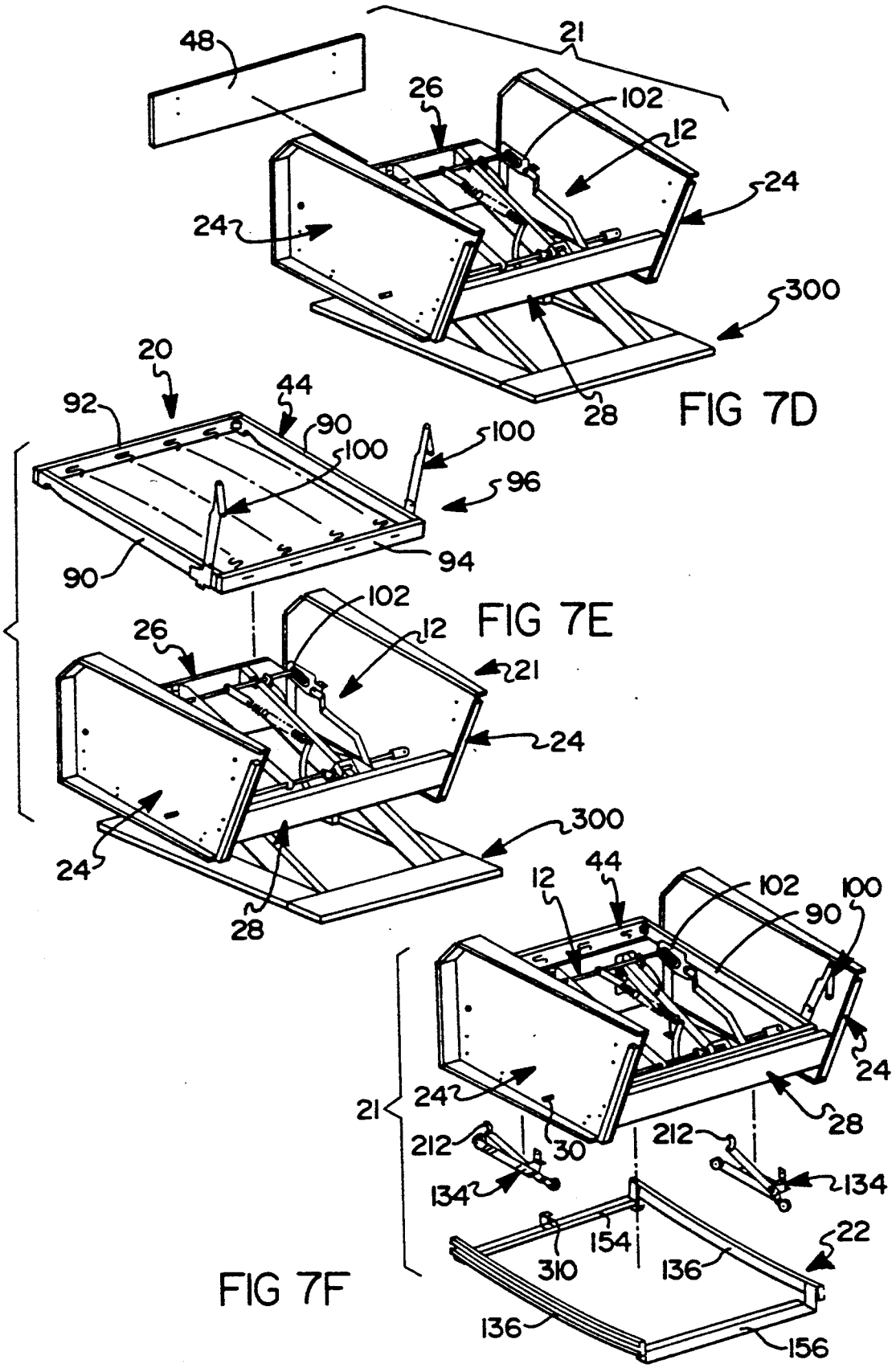

FIG. 7D illustrates the integrated and interdependent relationship of the four primary frame components which, when assembled, define an extremely rigid "box-like" upholstered chair body 21 within which actuation mechanism 12 is suspended. As noted, this "integrated" construction permits the elimination of the separate mechanism frame assembly conventionally provided for supporting the actuation mechanisms in prior known reclining chairs. As seen jig 300 is designed to permit the various frame components to be interconnected in an extremely efficient manner. Following assembly of chair body 21, frame board 48 is fixedly secured to angled brackets of pantograph linkages 34. Again, it is to be understood that frame board 48 has been pre-assembled as an upholstered unit prior to being assembled as part of chair body 21.

With particular reference now to FIG. 7E, the four pre-assembled frame components defining chair body 21 are shown supported from jig 300 with actuation mechanism 12 integrally suspended therefrom. In accordance with the next operation, upholstered seat member 20 (which includes seat frame 44 with its appropriate upholstery padding and springs) is interconnected to chair body 21. While not critical, notches may be formed in the front underside edges of seat frame side bars 90 for aligning seat frame 44 with respect to support shaft 32. Next, rear swing linkages 100, which have been pre-assembled onto seat frame 44 of upholstered seat member 20, are fixedly secured to side panels 50 via support brackets 106. Once support brackets 106 are fixedly secured to side panels 50 (via suitable fasteners), pivot points 110 between swing links 104 and support brackets 106 are operable to define the third set of "fixed" pivot points about which seat assembly 14 is reclinable. Alternatively, support brackets 106 of rear swing linkages 100 can be initially mounted directly to side panels 50 such that angled brackets 108 can be thereafter secured to upholstered seat member 20. In this manner, seat member 20 can be "flipped over" to permit seat brackets 108 to be securely fastened to side bars 90 of seat frame 44. With seat frame 44 positioned such that support shaft 32 is properly located, slide brackets 102 are pulled inwardly until vertically extending flanges 119 abuttingly engage the inner surface of seat frame side bars 90. Thereafter, suitable fasteners (such as wood screws) are driven through holes in horizontal flanges 118 to securely fix slide brackets 102 to an underside surface of seat side bars 90. Thereafter, tension springs 115 may be installed between seat brackets 108 and locating pin 109 extending from side panels 50.

With particular reference now to FIG. 7F, base assembly 22 is shown pre-assembled and includes bores provided in front cross bar 154 for attaching lower flange portions of push linkage base brackets 160 as well as stop brackets 310. Preferably, rigid chair body 21 is removed from jig 300 for inserting wheeled units 190 and 204 of bearing link assemblies 134 in the channels of tracks 136. More preferably, this is accomplished by setting chair body 21 in an upside down position on its arms and orienting base assembly 22 relative thereto such that tracks 136 of base assembly 22 are slidably inserted over wheeled units 190 and 204 of the laterally spaced bearing link assemblies 134. A single stop bracket 310, centered on front cross bar 154, abuts a correspondingly positioned stop block 312 on front rail assembly 26 of chair frame 21 when base assembly 22 has been slid onto chair frame 21. Thereafter, brackets 158 of push linkages 158 are fixedly secured to front cross bar 154. In this manner, chair body 21 is pivotally connected for "tilting" movement with respect to base assembly 22 during reclining movement of seat assembly 14. Thereafter, pivot connection 216 between toggle link 212 and connector link 214 is made via a self tapping rivet. In this manner, tilt linkages 182 and bearing link assemblies 134 are operably coupled to actuation mechanism 12. Finally, FIGS. 7G and 7H illustrate the manner in which upholstered seat back 18 can be detachably secured to upholstered seat member 20 via swing links 104 and slide brackets 132. Actuator handle 42 can then be installed on one end of drive rod 30.

As is apparent from examination of FIGS. 7A through 7H, the pre-assembled components can be interconnected in a number of other acceptable sequential operations to produce "knock-down" or modular chair 10. The method of assembly disclosed herein is advantageous in that virtually all of the components can be pre-assembled "off-line" for quick and efficient modular interconnection in a highly repeatable and precise fashion.

In addition to assembly of wall proximity reclining/tilt chair 10, the "knock-down" assembly method of the present invention can likewise be used to assemble the modular components of loveseats, sofas, sectional units and the like that have at least one seat section which defines a wall proximity reclining/tilt seating unit substantially similar to chair 10. For example, FIG. 2A illustrates an inboard side frame assembly 24' that has been recessed to eliminate the arm but which still provides for the three-pivot anchorage of actuation mechanism 12. Side frame assembly 24' includes a reinforced bottom rail 52' for permitting installation of a wheeled bearing link mechanism 134 thereon. Substitution of side frame assembly 24' for either of left or right side frame assemblies shown in FIG. 2, with all other components being the same, would produce a seat until that could be used as an end section on loveseats, sofas and sectionals. In addition, use of left and right side frame assemblies 24' would permit use of a reclining/tilt seating unit as a center section in a sofa or sectional. In this manner, wall proximity reclining/tilt seating units, similar to chair 10 can be assembled in combination with non-reclining seating units in any desired arrangement. Preferably, such combination of seating unit sections are assembled using a "knock-down" rail system as disclosed in U.S. patent application Ser. No. 07/686,581, filed Apr. 17, 1991, and entitled "Mounting Apparatus For A Modular Sofa Assembly", commonly owned by the same assignee as the instant application, the disclosure of which is expressly incorporated by reference herein.

The foregoing discussion discloses and describes exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A method for assembling a wall proximity reclining chair comprising the steps of:

providing an actuation mechanism;

suspending said actuation mechanism between a pair of side frame members;

interconnecting cross rail members with said side frame members to define a chair frame within which said actuation mechanism is operably supported;

providing a seat assembly having a seat, a seat back, and swing link means for pivotally interconnecting said seat back and said seat;

connecting said swing link means to said side frame members for suspending said seat assembly therebetween, said swing link means operable to permit reclining movement of said seat assembly with respect to said chair frame between an upright position and a reclined position in response to pressure applied by a seat occupant to said seat back;

connecting bearing linkages to a lower portion of said side frame members, said bearing linkages having wheel means secured thereon;

providing a stationary base assembly having track means; and inserting said wheel means of said bearing linkages into said track means, whereby said chair frame is supported for translation movement relative to said base assembly in response to reclining movement of said seat assembly.

2. The method of claim 1 wherein said actuation mechanism includes a drive rod and a support shaft that are rigidly maintained in predetermined spatial arrangement to permit sliding insertion of the opposite ends thereof into first and second sets of alignable bores formed in said side frame members, and wherein said drive rod is selectively rotatable with respect to said second set of alignable bores while said support shaft is inhibited from rotation within said first set of alignable bores in response to rotation of said drive rod.

3. The method of claim 2 wherein said step of connecting said swing link means comprises:

connecting said swing link means to a third set of alignable bores formed in said side frame members;

providing guide means for guiding and limiting the fore and aft movement of said seat with respect to said support shaft in response to reclining movement of said seat assembly; and connecting a frame portion of said seat to said guide means.

4. The method of claim 3 further comprising the step of operably suspending a leg rest assembly from said front support shaft and said drive rod of said actuation mechanism for movement between a retracted position and an extended position in response to selective rotation of said drive rod, said movement of said leg rest assembly being independent from said reclining movement of said seat assembly and said translational movement of said chair frame, said leg rest assembly including a leg rest frame board and a pantograph linkage, said pantograph linkage being journally suspended from said support shaft and directly coupled to said drive rod such that selective rotation of said drive rod moves said leg rest frame board between said retracted and extended positions.

5. The method of claim 4 further comprising the step of connecting tilt linkages between said drive rod and said bearing linkages for tilting said chair frame relative to said base assembly in response to movement of said leg rest assembly.

6. The method of claim 5 further comprising the step of suspending an over-center linkage between said drive rod and said support shaft, said over-center linkage having spring means for biasingly retaining said leg rest assembly in said retracted position when said drive rod is rotated to a first position and for biasingly driving said leg rest assembly toward said extended position when said drive rod is rotated to a second position.

7. The method of claim 5 further comprising the steps of providing push link means that are suspended from said guide means of said swing link means and said drive rod of said actuation mechanism, and connecting said push link means to said base assembly for causing said translational movement of said bearing linkages within said track means in response to reclining movement of said seat assembly, whereby said seat assembly can be reclined independently from actuation of said leg rest assembly.

8. The method of claim 7 further comprising orienting said track means to cause said chair frame to tilt relative to said base assembly upon translational movement of said bearing linkages within said track means, said tilting movement due to translational movement and tilting movement due to movement of said leg rest assembly being independent and cumulative in nature.

9. The method of claim 1 further comprising the step of upholstering said left and right side frame members and said cross frame members prior to interconnection into said rigid chair frame.

10. The method of claim 1 further comprising the step of providing stop means between said side frame members and said base assembly to assist in making said chair frame rigidly stationary by defining the limits of said translational movement therebetween.

11. A method of modular assembly for a wall proximity reclining chair, said method comprising the steps of:

providing an actuation mechanism having first and second shafts;

providing a pair of side frame members;

inserting opposite ends of said first shaft into a first set of alignable bores formed in said side frame members for suspending said first shaft therebetween;

inserting opposite ends of said second shaft into a second set of alignable bores formed in said side frame members for suspending said second shaft therebetween;

connecting front and rear cross frame members between said side frame members to define a chair frame, said actuation mechanism being integrally retained within said chair frame;

providing a seat assembly having a seat, a seat back, and swing link means for pivotally interconnecting said seat back and said seat;

connecting said swing link means to a third set of alignable bores formed in said side frame members for suspending said seat assembly therebetween, said swing link means operable to permit reclining movement of said seat assembly with respect to said chair frame between an upright position and a reclined position in response to pressure applied by a seat occupant to said seat back;

connecting guide means between said second shaft and said seat for guiding and limiting fore and aft movement of said seat with respect to said second shaft in response to reclining movement of said seat assembly;

connecting bearing linkages to a lower portion of said side frame members, said bearing linkages having wheel means secured thereon;

providing a stationary base assembly having track means;

inserting said wheel means of said bearing linkages into said track means for permitting translational movement of said chair frame relative to said base assembly in response to reclining movement of said seat assembly;

connecting push linkages that are suspended between said first shaft and said guide means to said base assembly for cooperating with said swing link means to cause said translational movement of said chair frame;

supporting a leg rest assembly from said first and second shafts for movement between a retracted position and an extended position in response to selective rotation of said first shaft, said movement of said leg rest assembly being independent from said reclining movement of said seat assembly; and connecting tilt linkages between said first shaft and said bearing linkages for tilting said chair frame relative to said base assembly in response to movement of said leg rest assembly.

12. The method of claim 11 wherein said first shaft of said actuation mechanism is a drive rod and said second shaft is a support shaft, said drive rod and said support shaft being rigidly maintained in a predetermined spatial arrangement to permit sliding insertion of the opposite ends thereof into said first and second sets of alignable bores formed in said side frame members, and wherein said drive rod is selectively rotatable with respect to said first set of alignable bores while said support shaft is inhibited from rotation within said second set of alignable bores in response to rotation of said drive rod.

13. The method of claim 12 wherein said leg rest assembly includes a leg rest frame board and pantograph linkage means journally suspended on said front support shaft and drivingly coupled to said drive rod for moving said leg rest frame board between said retracted and extended positions in response to selective actuation of said drive rod.

14. The method of claim 13 wherein said tilt linkage is operably coupled to said drive rod for simultaneous operation with said leg rest assembly, wherein when said leg rest assembly is in said retracted position said tilt linkage moves said chair frame to a non-tilted position, and when said leg rest assembly is in said extended position said tilt linkage moves said chair frame to a tilted position.

15. The method of claim 13 further comprising the step of suspending an over-center linkage between said drive rod and said support shaft, said over-center linkage having spring means for biasingly retaining said leg rest assembly in said retracted position when said drive rod is rotated to a first position and for biasingly driving said leg rest assembly toward said extended position when said drive rod is rotated to a second position.

16. A method for assembling a wall reclining chair comprising:

providing means defining a chair frame having side frame members interconnected with cross rail members;

suspending an actuation mechanism between said side frame members;

pivotally interconnecting a seat and seat back;

operably connecting said interconnected seat and seat back to said chair frame for reclining movement;

providing a base assembly, said base assembly including support means for supporting said chair frame for translational movement in response to reclining movement of said seat assembly; and supporting said chair frame on said support means.

17. The method of claim 16 wherein said step of suspending an actuation mechanism includes suspending a drive rod and support shaft between said first and second side frame members.

18. The method of claim 17 further comprising the step of operably suspending a leg rest assembly from said support shaft and drive rod for movement between a retracted position and an extended position in response to selective rotation of said drive rod.

19. The method of claim 18 further comprising the step of connecting tilt means between said drive rod and said support means for tilting said chair frame relative to said base assembly in response to movement of said leg rest assembly.

20. The method of claim 19 further comprising the step of providing push link means for interconnecting said seat assembly and said base assembly for causing translational movement of said chair frame in response to reclining movement of said seat assembly independently of actuation of said leg rest assembly.

* * * * *